US006085704A

United States Patent [19]

Hara

[11] Patent Number: 6,085,704

[45] Date of Patent: Jul. 11, 2000

[54] ELECTROMAGNETICALLY OPERATING ACTUATOR FOR INTAKE AND/OR EXHAUST VALVES

[75] Inventor: Seinosuke Hara, Kanagawa, Japan

[73] Assignee: Unisia Jecs Corporation, Atsugi, Japan

[21] Appl. No.: 09/147,467

[22] PCT Filed: May 13, 1998

[86] PCT No.: PCT/JP98/02110

§ 371 Date: Jan. 4, 1999

§ 102(e) Date: Jan. 4, 1999

[30] Foreign Application Priority Data

May 13, 1997 [JP] Japan ..... 9-121826
Jan. 26, 1998 [JP] Japan ..... 10-012197

[51] Int. Cl.[7] ..... F01L 9/04

[52] U.S. Cl. ..... 123/90.11; 123/90.55; 123/90.6; 25/129.01; 25/129.16

[58] Field of Search ..... 123/90.11, 90.15, 123/90.16, 90.17, 90.39, 90.48, 90.55, 90.6; 251/129.01, 129.1, 129.15, 129.16

[56] References Cited

U.S. PATENT DOCUMENTS

| | | | |
|---|---|---|---|
| 4,762,095 | 8/1988 | Mezger et al. | 123/90.11 |
| 4,867,111 | 9/1989 | Schneider et al. | 123/90.11 |
| 4,942,854 | 7/1990 | Shirai | 123/90.17 |
| 5,117,213 | 5/1992 | Kreuter et al. | 335/219 |
| 5,161,494 | 11/1992 | Brown, Jr. | 123/90.11 |
| 5,636,601 | 6/1997 | Moriya | 123/90.11 |
| 5,772,179 | 6/1998 | Morinigo et al. | 251/129.1 |

FOREIGN PATENT DOCUMENTS

| | | |
|---|---|---|
| 56-14817 | 2/1981 | Japan . |
| 58-167707 | 11/1983 | Japan . |
| 62-271915 | 11/1987 | Japan . |
| 1-301903 | 12/1989 | Japan . |
| 2-34703 | 3/1990 | Japan . |
| 7-305613 | 11/1995 | Japan . |
| 8-21220 | 1/1996 | Japan . |
| 2 058 992 | 4/1981 | United Kingdom . |

*Primary Examiner*—Weilun Lo
*Attorney, Agent, or Firm*—Foley & Lardner

[57] ABSTRACT

An electromagnetically operating actuator includes a casing (29) that accommodates an armature (30), a valve-closing electromagnet (32), a valve-opening electromagnet (32), and a valve-opening spring (33). The casing is fixed to an upper face of a cylinder head (21) in which an intake valve (23) and a valve litter (27) are slidably moveable. A valve-closing spring (28) is installed between the valve lifter and a bottom face of a retention hole **(21*a*). Further, a transmission cam (46) with first and second cam surfaces (51, 52) is interposed between the valve lifter and a tappet (39) connected with the center of the armature through a tappet shaft (38). The transmission cam is pivotable upward and downward. A hydraulic lash adjuster (47)** associated with the transmission cam is disposed within the casing. This arrangement can prevent the intake and/or exhaust valves from abruptly moving at the opening and closing timings, to reduce strike and abrasion noise and to improve mountability of the actuator relative to an engine.

8 Claims, 16 Drawing Sheets

Fig.1

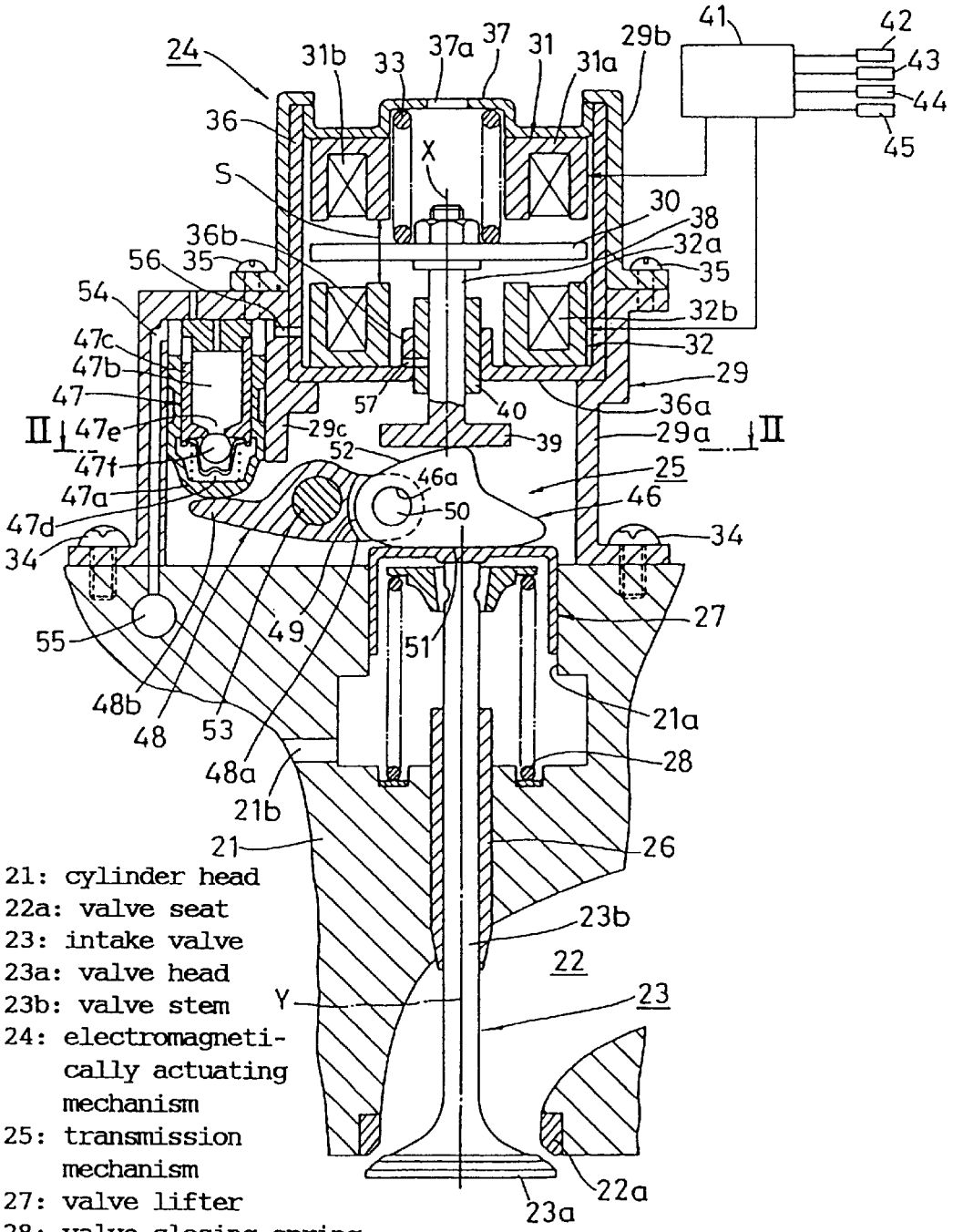

21: cylinder head
22a: valve seat
23: intake valve
23a: valve head
23b: valve stem
24: electromagnetically actuating mechanism
25: transmission mechanism
27: valve lifter
28: valve-closing spring
29: casing
30: armature
31: valve-closing electromagnet
32: valve-opening electromagnet
33: valve-opening spring
38: main shaft
39: tappet
41: electronic control unit
46: transmission cam
47: hydraulic lash adjuster
48: transmission arm
50: cam shaft
51: first cam surface
52: second cam surface

ELECTROMAGNETICALLY OPERATING ACTUATOR FOR INTAKE AND/OR EXHAUST VALVES

TECHNICAL FIELD

The present invention relates to an electromagnetically operating actuator for actuating intake and/or exhaust valves, for example, of an internal combustion engine of vehicles, by mainly using an electromagnetic force.

BACKGROUND ART

There has been known such a kind of electromagnetically operating actuator as described in conventional art documents, for instance, Japanese Patent Application First Publication (KOKAI) No. 8-21220.

Briefly explaining in accordance with FIG. 16, the conventional electromagnetically operating actuator includes an intake valve 2 slidably moveable in a cylinder head 1 of an engine, and an electromagnetically actuating mechanism 3 for actuating the intake valve 2 to be open and closed.

The intake valve 2 includes a valve head 2*a* opening and closing an open end of an intake port 4, and a valve stem 2*b* formed integrally with an upper end portion of the valve head 2*a*.

The electromagnetically actuating mechanism 3 includes a casing 5 fixed onto the cylinder head 1, a disk-like armature 6 fixed to an upper end portion of the valve stem 2*b* inserted into the casing 5, and a valve-closing electromagnet 7 and a valve-opening electromagnet 8 which are arranged in an inner-upper position and an inner-lower position within the casing 5 and attractively move the armature 6 to close and open the intake valve 2.

Installed between an upper wall of the casing 5 and an upper face of the armature 6 is a valve-opening spring 9 which biases the intake valve 2 in such a direction as to open the intake valve 2. A valve-closing spring 10 is installed between a lower face of the armature 6 and a bottom surface of a spring-seat groove formed on an upper face of the cylinder head 1, which biases the intake valve 2 in such a direction as to close the intake valve 2. Further, the electromagnets 7 and 8 have coils receiving a control current output generated from an electronic control unit 12 via an amplifier 11, respectively.

The electronic control unit 12 is adapted to control an amount of energizing each of the electromagnets 7 and 8 depending on detection signal outputs generated from an engine speed sensor 13 and a temperature detection sensor 14 for the valve-closing electromagnet 7. Reference numeral 15 denotes a power source.

The biasing forces of the two springs 9 and 10 and the attracting forces of the two electromagnets 7 and 8 cooperate together such that the biasing forces are accumulated and retained as a potential energy in the springs 9 and 10 and the electromagnetic forces are alternately repeatedly released from the intake valve 2 and applied thereto. The intake valve 2 is thus actuated to be open and closed.

However, in the conventional electromagnetically operating actuator, at the opening and closing timings of the intake valve 2, the electromagnetically attracting forces of the electromagnets 7 and 8 increase beyond the biasing forces of the springs 9 and 10 which act against the attracting forces, respectively. It is likely that the valve head 2*a* is caused to strongly conflict with a valve seat 4*a* at the valve-closing timing and that the armature 6 is caused to conflict with the valve-opening electromagnet 8 at the valve-opening timing.

Referring to FIGS. 17A and 17B, a theory of increase of the attracting forces of the respective electromagnets 7 and 8 is explained. FIG. 17B shows characteristics of the electromagnetically attracting forces and characteristics of the biasing forces of the springs 9 and 10 at the opening and closing timings of the intake valve 2. First, when the intake valve closes, the attracting force of the valve-closing electromagnet 7 causes the armature 6 to move upward. Therefore, the valve-closing spring 10 is expanded as the intake valve 2 slidingly moves upward, while the valve-opening spring 9 is compressed to increase the biasing force to be accumulated therein.

Next, when the intake valve opens, OFF signal (disenergizing state signal) is transmitted to the valve-closing electromagnet 7 while ON signal (energizing state signal) is transmitted to the valve-opening electromagnet 8. The armature 6 is attractively moved downward so that the intake valve 2 slidingly moves downward. Then, the valve-opening spring 9 is expanded, while the valve-closing spring 10 is compressed to increase the biasing force to be accumulated therein.

Accordingly, at the closing and opening timings, the sliding speed of the intake valve 2 decreases due to the increasing biasing forces of the respective valve-opening and valve-closing coil springs 9 and 10. At the time of shifting the intake valve from the closing state to the opening state and vice versa, the attracting force of the electromagnet 7 and 8 in the attracting condition increases abruptly as well as reaction forces of the springs in the compression state and the expansion state. Namely, the electromagnetically attracting forces of the electromagnets 7 and 8 increase in inverse proportion to substantially the square of a distance between the armature 6 and fixed cores 7*a* and 8*a* of the electromagnets 7 and 8, respectively. Therefore, the increasing attracting force exceeds the composite biasing force of the springs 9 and 10 conditioned in the compression state and the expansion state, respectively, so that the armature 6 is urged to move quickly upward or downward without adequately reducing the sliding speed. Accordingly, as shown in FIG. 17A, the intake valve 2 abruptly moves up and down at the maximum opening and closing timings. As a result, the valve head 2*a* abuts on the valve seat 4*a* at the valve-closing timing, while the armature 6 abuts on the valve-opening electromagnet 8 at the valve-closing timing. In the respective cases, it is likely to cause great strike noise and abrasion on the armature 6 and the valve seat 4*a*, and the like.

In addition, in the conventional actuator, since the valve head 2*a* of the intake valve 2 urges the valve seat 4*a* at a suitable surface pressure, it is required to appropriately balance the attracting force of the valve-closing electromagnet 7 with the biasing force of the valve-opening spring 9. However, there occurs a change in the gap between the armature 6 and the fixed core 7*a* of the electromagnet 7 due to permanent set of the respective springs 9 and 10 which results from deterioration with age, thermal expansion of the valve stem 2*b*, abrasion of the valve seat 4*a*, and the like. This causes a great change in the electromagnetic force. As a result, it will fail to obtain a sufficient retaining force required to maintain the intake valve in the closing state and there will be generated a clearance between the valve head 2*a* and the valve seat 4*a*. Then, it is likely that a sealability of the intake valve is reduced and foreign objects such as carbon are accumulated on the seat portion. This tends to deteriorate radiating property of the valve, causing meltdown of the valve.

Further, in the conventional art, when the actuator is mounted onto the cylinder head 1, first the intake valve 2 is inserted into the cylinder head 1 from a lower portion thereof. Subsequently, the valve-opening electromagnet 8 is attached to the upper end portion of the valve stem 2*b* and then the armature 6 is fixed to the valve stem 2*b*. That is, since the components of the electromagnetically actuating mechanism 3 must be assembled on the cylinder head 1, the assembly work becomes inconvenient. Particularly, since it is required to accurately place the armature 6 at the upper limit and lower limit positions in order to obtain the appropriate valve-closing retention force as described above, in the assembly work, the working efficiency tends to decrease.

SUMMARY OF THE INVENTION

The present invention contemplates solving the above-mentioned problems of the conventional actuator. According to an aspect of the invention, there is provided an electromagnetically operating actuator including an armature associated with intake and/or exhaust valves of an engine, valve-opening and valve-closing electromagnets attracting the armature to open and close the intake and/or exhaust valves, and valve-opening and valve-closing spring members biasing the intake and/or exhaust valves in the closing direction and the opening direction to retain the intake and/or exhaust valves in neutral positions, comprising:

a transmission mechanism for transmitting a force for actuating the intake and/or exhaust valves in the closing and opening directions, via a transmission cam, said transmitting mechanism being interposed between a valve lifter provided on an end of a valve stem of the intake and/or exhaust valves, and a tappet disposed at the center of the armature in opposed relation to the valve lifter.

According to another aspect of the invention, there is provided the actuator in which the transmission cam includes a first arcuately convex cam surface contacting the valve lifter and a second arcuately convex cam surface contacting the tappet, and the transmission cam is pivotable at its one end as a fulcrum.

According to another aspect of the invention, there is provided the actuator in which the second cam surface of the transmission cam is so configured as to have a length shorter than the first cam surface to thereby determine a lift amount of the tappet that is less than a lift amount of the valve lifter, the lift amount of the tappet being obtained by the pivotal movement of the transmission cam.

According to another aspect of the invention, there is provided the actuator in which the valve-closing spring member is installed between the valve lifter and a cylinder head, and a lash adjuster for adjusting a valve clearance of the intake and/or exhaust valves to zero is associated, via an arm, with a cam shaft supporting the one end portion of the transmission cam so as to be pivotable thereon.

According to another aspect of the invention, there is provided the actuator in which an axis of the valve stem of the intake and/or exhaust valves and an axis of a tappet shaft of the tappet are offset from each other in a width direction of the engine.

According to another aspect of the invention, there is provided the actuator in which an electromagnetically actuating mechanism including the armature, the electromagnets and the tappet, and the transmission mechanism including the transmission cam and a lash adjuster, are accommodated in a casing, and in which the casing is secured onto a cylinder head.

According to another aspect of the invention, there is provided the actuator in which the valve closing spring member is installed between the valve lifter and a cylinder head, and in which a lash adjuster for adjusting the valve clearance of the intake and/or exhaust valves to zero is disposed within the valve lifter.

According to the present invention as set forth in claim 8, there is provided the actuator in which a pair of opposed boss portions are disposed on an inner surface of a casing accommodating the transmission cam, and in which the transmission cam is so arranged as to move pivotally upward and downward on a cam shaft as a fulcrum that is disposed between the pair of opposed boss portions.

BRIEF DESCRIPTION OF DRAWINGS

FIG. 1 is a vertical cross section of an actuator of a first embodiment according to the present invention;

DETAILED DESCRIPTION OF THE PREFERRED EMBODIMENTS

Figure 2:
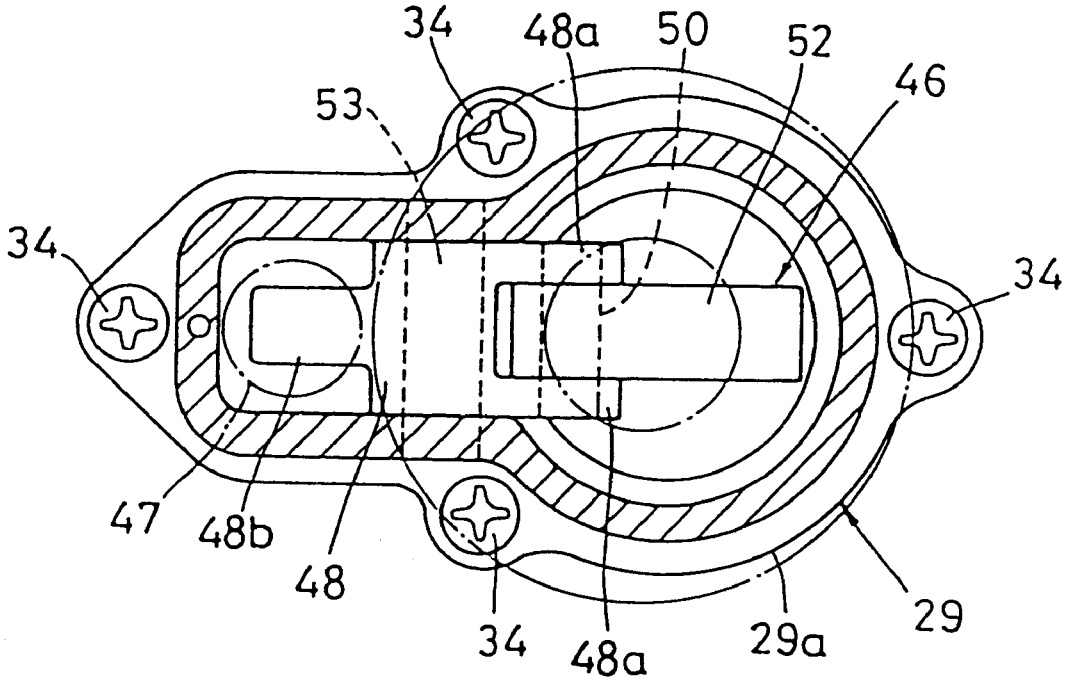
FIG. 2 is a section taken along line II—II of FIG. 1.

FIGS. 1 to 4 illustrate the first embodiment in which an electromagnetically operating actuator usable for intake and/or exhaust valves, according to the present invention, is applied to the intake valve. The actuator includes an electromagnetically actuating mechanism 24 for actuating an intake valve 23 for opening and closing an open end of an intake port 22 that is formed in a cylinder head 21, and a transmission mechanism 25 interposed between the intake valve 23 and the electromagnetically actuating mechanism 24.

The intake valve 23 includes a valve head 23*a* that is disengaged from and engaged with an annular valve seat 22*a* at the open end of the intake port 22 exposed to a combustion chamber, to thereby open and close the open end. A valve stem 23*b* formed integrally with the valve head 23*a* is disposed at the center of an upper surface of the valve head 23*a* and slidably moves inside the cylinder head 21 through a valve guide 26. A valve lifter 27 of a cylindrical shape having a closed end is disposed at an end portion of the valve stem 23*b* and slidably moves in a retention hole 21*a* of the cylinder head 21. Further, the intake valve 23 is urged in a closing direction by a biasing force of a valve spring 28 that is installed between a cotter fixed to a stem end of the valve stem 23*b*, and a bottom face of the retention hole 21*a*. Meanwhile, the retention hole 21*a* is connected with a vent hole 21*b* at a lower portion thereof.

The electromagnetically actuating mechanism 24 includes a casing 29 disposed on the cylinder head 21 and a disk-shaped armature 30 disposed moveably upward and downward within the casing 29. The electromagnetically actuating mechanism 24 also includes an upper valve-closing electromagnet 31 and a lower valve-opening electromagnet 32 which are fixedly placed at upper and lower positions in such a way that the armature 30 is interposed therebetween. The electromagnetically actuating mechanism 24 further includes a valve-opening spring 33 biasing the intake valve 23 in an opening direction through the armature 30 and the like.

As illustrated in FIGS. 1 and 2, the casing 29 includes a body 29*a* made of metal and fixed to the cylinder head 21 by using four screws 34, and a cover 29*b* made of non-magnetic material and fixed to one side of an upper end portion of the body 29*a* by using screws 35. A cylindrical holder 36 made of non-magnetic material is arranged on an inner circumferential surface of the cover 29*b*. The cylindrical holder 36 has an open-upper end to which a stepped lid 37 is fixed. The lid 37 is made of non-magnetic material and retains the valve-closing electromagnet 31. The cylindrical holder 36 also has an integral bottom wall 36*a* at a lower end portion thereof which retains the valve-opening electromagnet 32. A vent hole 37*a* is formed at the center of the lid 37.

The armature 30 has upper and lower surfaces opposed to both of the electromagnets 31 and 32. A tappet shaft 38 extends downward through the center of the armature 30 and is fixed thereto by means of a fastening nut. A disk-shaped tappet 39 is disposed at a lower end of the tappet shaft 38 and formed integrally therewith. The tappet shaft 38 is slidably supported by a cylindrical guide 40 fittedly fixed to a cylindrical wall 36*b* disposed at the center of the bottom wall 36*a* of the holder 36. The tappet shaft 38 has an axis X offset from an axis Y of the valve stem 23*b* of the intake valve 23 by a predetermined distance in a direction of a width of an engine.

The valve-closing and valve-opening electromagnets 31 and 32 include fixed cores 31*a* and 32*a* having a generally U-shaped cross section, respectively. The fixed cores 31*a* and 32*a* are arranged to be opposed to the armature 30 with a relatively small clearance S. Electromagnetic coils 31*b* and 32*b* are disposed within the fixed cores 31*a* and 32*a* in a winding state, respectively. The electromagnetic coils 31*b* and 32*b* receive energizing and disenergizing signals generated from an electronic control unit 41 described later, such that the armature 30 is attractively moved upward or downward and released from the attraction.

The valve-opening spring 33 is installed between a central portion of an upper face of the armature 30 and a rear face of the lid 37. When the respective electromagnets 31 and 32 are in the disenergized state, the biasing force of the spring 33 balances with the biasing force of the valve-closing spring 28 such that the armature 30 is held in substantially an equilibrium neutral position between the electromagnets 31 and 32. In this condition, the intake valve 23 is kept in substantially an intermediate position between the closed position and the open position.

The electronic control unit 41 repeatedly generates the energizing and disenergizing signals to be transmitted to the valve-closing and valve-opening electromagnets 31 and 32 depending on detection values detected respectively by an engine crank angle sensor 42, an engine speed sensor 43, a temperature sensor 44 detecting a temperature of the valve-closing electromagnet 31, and an air-flow meter 45 detecting an engine load. The rotation angle value detected by the crank angle sensor 42 is used for controlling the opening and closing timings of the intake valve 23 in synchronous relation to rotation of a crankshaft. The detection value detected by the engine speed sensor 43, i.e., the number of the rotation of the crankshaft, is used for controlling an allowable time of the attraction of the respective electromagnets 31 and 32 which varies depending on the number of the rotation of the crankshaft. The detection value detected by the temperature sensor 44 is used for determining a resistance increase that is caused in the energized electromagnetic coil 31*b* of the valve-closing electromagnet 31 due to a temperature raise. The engine load value detected by the air-flow meter 45 is used for optimally controlling the opening and closing timings of the intake valve 23, as well as the engine speed value.

The transmission mechanism 25 is arranged on one side of the inside of the body 29*a* of the casing 29. The transmission mechanism 25 includes a transmission cam 46 interposed between the valve lifter 27 and the tappet 39, a hydraulic lash adjuster 47 adjusting a valve clearance of the intake valve 23 to zero via the transmission cam 46, and an arm 48 transmitting the action of the hydraulic lash adjuster 47 to the transmission cam 46.

Figure 5:
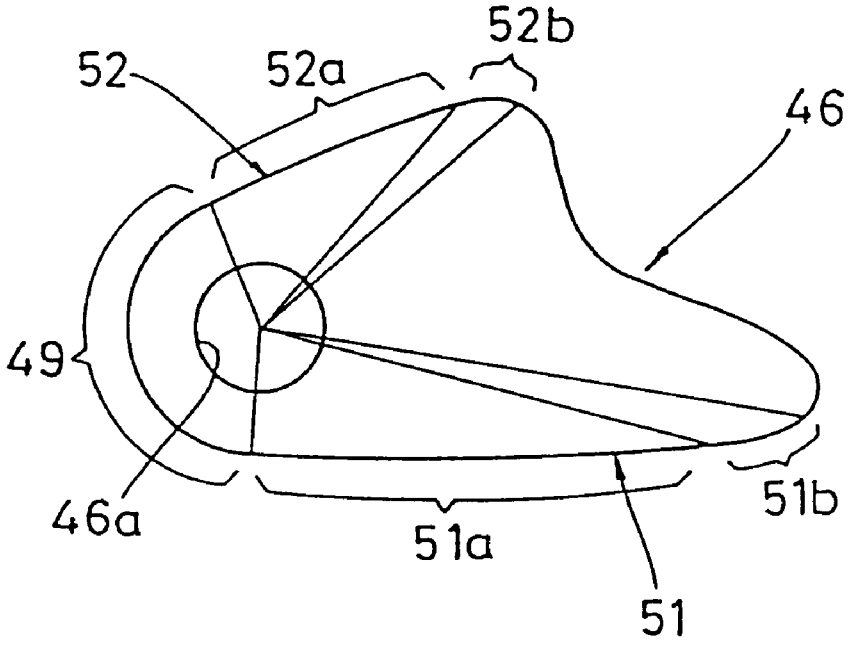
FIG. 5 is an elevation of a transmission cam used in the first embodiment.

The transmission cam 46 has an elevation of a shape of Japanese character "し" lying, as shown in FIGS. land 5. The transmission cam 46 is mounted onto a cam shaft 50 so as to be pivotable upward and downward about the cam shaft 50 as a fulcrum. The cam shaft 50 is inserted into a shaft hole 46*a* formed in an arcuate base portion 49 that is disposed at one end of the transmission cam 46. The transmission cam 46 has a first arcuately convex cam surface 51 on its lower face contacted with an upper face of the valve lifter 27, and a second arcuately convex cam surface 52 on its upper face contacted with a lower face of the tappet 39. The first cam surface 51 extends further than the second cam surface 52 and has an area greater than an area of the second cam surface 52, as shown in FIG. 5. The first cam surface 51 has a first ramp portion 51*a* defining a gently curved surface, on the side of the base portion 49, and a first lift portion 51*b* defining an arcuate surface which has a curvature greater than that of the first ramp portion 51*a*, on the distal end side. On the other hand, the second cam surface 52 has a second ramp portion 52*a* defining a gently curved surface, on the side of the base portion 49, and a second lift portion 52*b* defining an arcuate surface which has a curvature greater than that of the second ramp portion 52*a*, on the distal end side.

The arm 48 is mounted onto an arm shaft 53 to be pivotable like a seesaw on the arm shaft 53 as a fulcrum. The arm shaft 53 is supported at both ends thereof by opposed walls of the casing 29 that have a reduced width. The arm 48 has one fork-like end portion 48*a*, 48*a* that fittingly supports both ends of the cam shaft 50 and slidingly engages the base portion 49 of the transmission cam 46. The arm 48 has the opposite spatula-like end portion 48*b*, on an upper face of which a head of a body 47*a* as described later, of the lash adjuster 47 is arranged in contact therewith.

The lash adjuster 47 has a structure shown in FIG. 1. The lash adjuster 47 includes the cylindrical body 47*a* having a closed end, that is arranged within a generally cylindrical partition wall 29*c* disposed inside on one side of the casing body 29*a*. The body 47*a* is slidably moveable upward and downward on the partition wall 29*c*. A cylindrical plunger 47*c* having a reservoir 47*b* therein is disposed inside the body 47*a*. The plunger 47*c* has, at its lower end portion, a communication hole 47*e* communicating the reservoir 47*b* and a high-pressure chamber 47*d* defined within the head of the body 47*a*. A check ball 47*f* is arranged within the high-pressure chamber 47*d* so as to open and close the communication hole 47*e* by a spring or the like. Further, a lubricating oil is supplied from an oil gallery 55 into the reservoir 47*b* via an oil hole 54 formed in a part of a circumferential wall of the casing body 29*a* along a vertical direction. When the opposite end portion 48*b* of the arm 48 moves slightly downward, the fluid pressure within the reservoir 47*b* forces the check ball 47*f* to open so that the fluid pressure is applied to the body 47*a* via the high-pressure chamber 47*d*. This causes the body 47*a* to move downward to reduce the gap between the body 47*a* and the other end portion 48*b* so that a clearance between the transmission cam 46, the valve lifter 27 and the tappet 39 is always adjusted to decrease to zero. The oil gallery 55 is supplied with the lubricating oil from an oil pump, not shown. The lubricating oil leaking from the lash adjuster 47 flows into an oil hole 56 that extends through the partition wall 29*c* and the holder 36 and an oil hole 57 that is formed in the cylindrical wall 36*b* and the guide portion 40. The leaking lubricating oil is then supplied into a space between the tappet shaft 38 and the guide portion 40 to be used for lubricating them.

An operation of this embodiment will be explained hereinafter. First, when the engine is stopped, the electronic control unit 41 transmits no energizing signal to the electromagnetic coils 31*b* and 32*b* of the electromagnets 31 and 32, so that the electromagnetic coils are in disenergized state thereof. Therefore, as illustrated in FIG. 1, the armature 30 is placed in substantially the equilibrium neutral position within the clearance S by the relative biasing forces of the respective springs 28 and 33. The intake valve 23 is also placed in a neutral position spaced from the valve seat 22*a*. In this condition, the transmission cam 46 is in a position wherein the first ramp portion 51*a* of the first cam surface 51 contacts an upper face of the valve lifter 27 and the second lift portion 52*b* of the second cam surface 52 contacts a lower face of the tappet 39.

Figure 3:
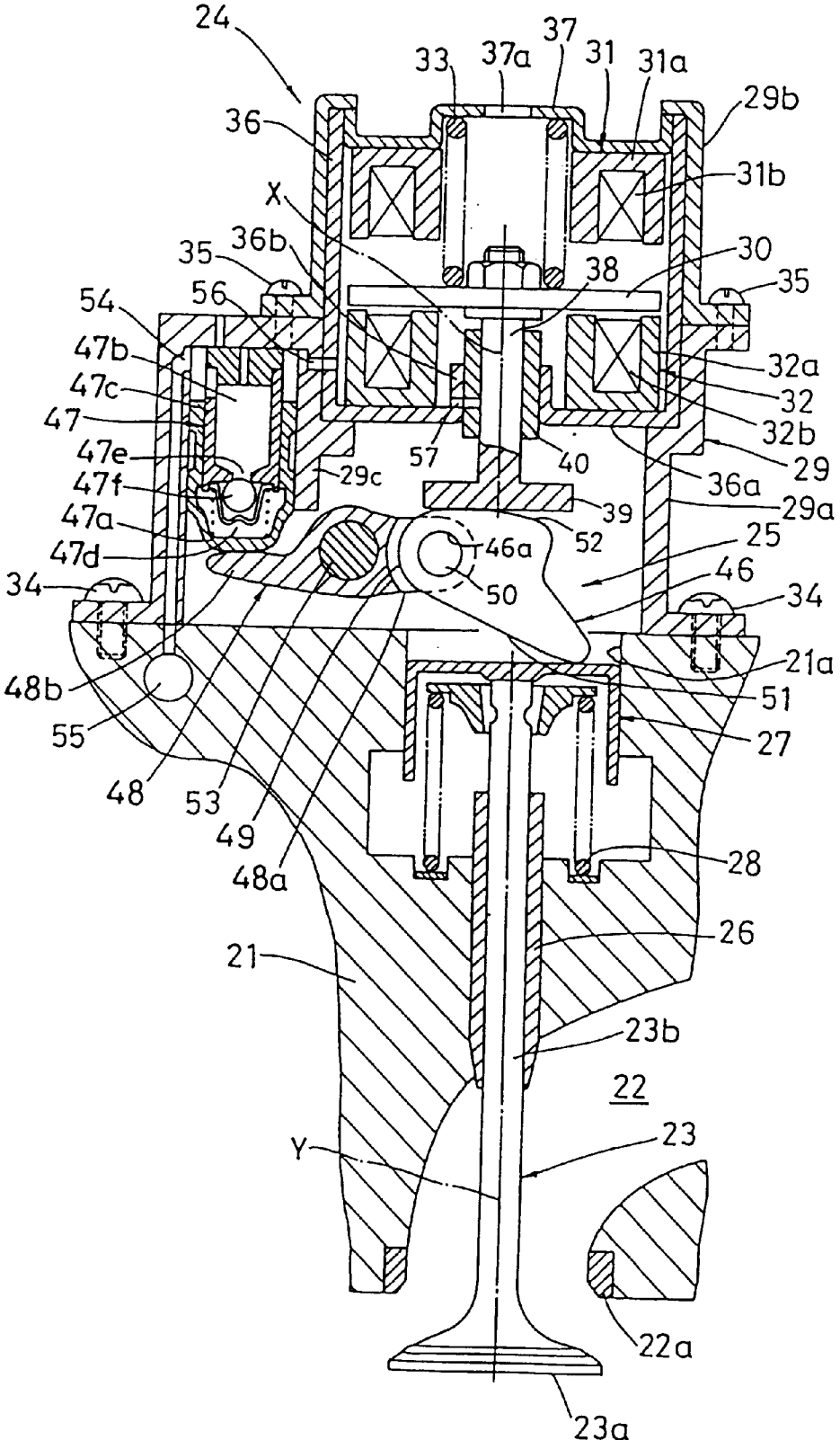
FIG. 3 is a vertical cross section of the actuator, showing a condition in which an intake valve is open.

When the engine starts, the electromagnetic coil 32*b* of the valve-opening electromagnet 32 receives the energizing signal generated from the electronic control unit 41. In this condition, as shown in FIG. 3, the armature 30 is attracted by the electromagnet 32 and depressed by the biasing force of the valve-opening spring 33 so that the tappet 39 urges the transmission cam 46 downward to rotate on the cam shaft 50 as the fulcrum. This causes the first ramp portion 52*a* of the second cam surface 52 to rotatively contact the tappet 39 and at the same time causes the first lift portion 51*b* of the first cam surface 51 to urge the upper face of the valve lifter 27. To this end, the intake valve 23 is moved downward to be open against the biasing force of the valve-closing spring 28.

Figure 4:
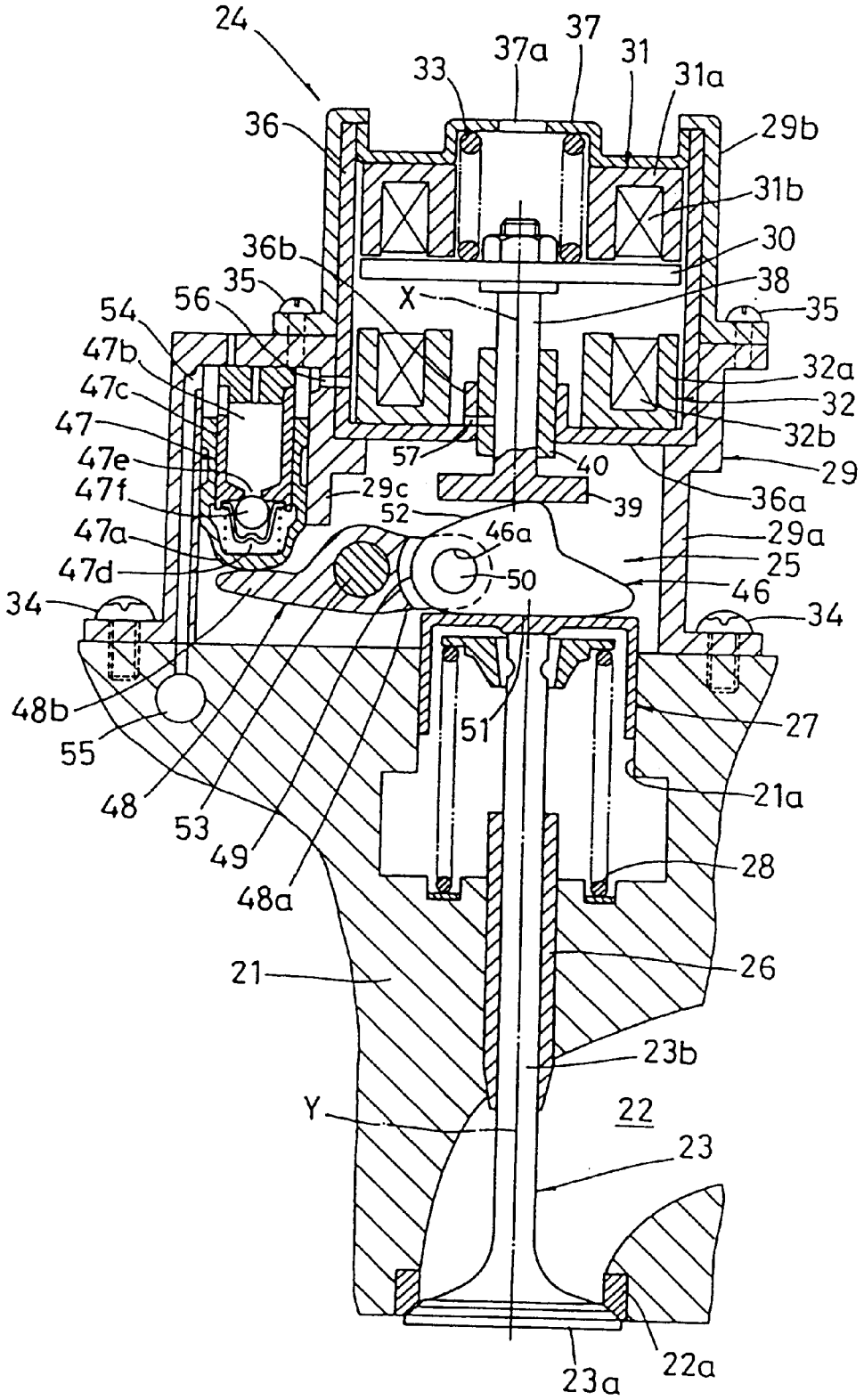
FIG. 4 is a vertical cross section of the actuator, showing a condition in which the intake valve is closed.

On the other hand, at the closing timing of the intake valve 23, the energization to the valve-opening electromagnet 32 is stopped, while the electromagnetic coil 31*b* of the valve-closing electromagnet 31 is energized. As shown in FIG. 4, the armature 30 is attracted by the electromagnet 31 to move upward, and at the same time, the valve lifter 27 is moved upward by the biasing force of the valve-closing spring 28 to urge the transmission cam 46 upward. The transmission cam 46 is pivotally moved upward so that the first ramp portion 51*a* of the first cam surface 51 is rotatively contacted with the upper face of the valve lifter 27 and the second lift portion 52*b* of the second cam surface 52 urges the tappet 39 upward. This causes the intake valve 23 to move upward against the biasing force of the valve-opening spring 33 so that the valve head 23*a* is placed on the valve seat 22*a*. Thus, the intake valve 23 is closed.

Figure 6:
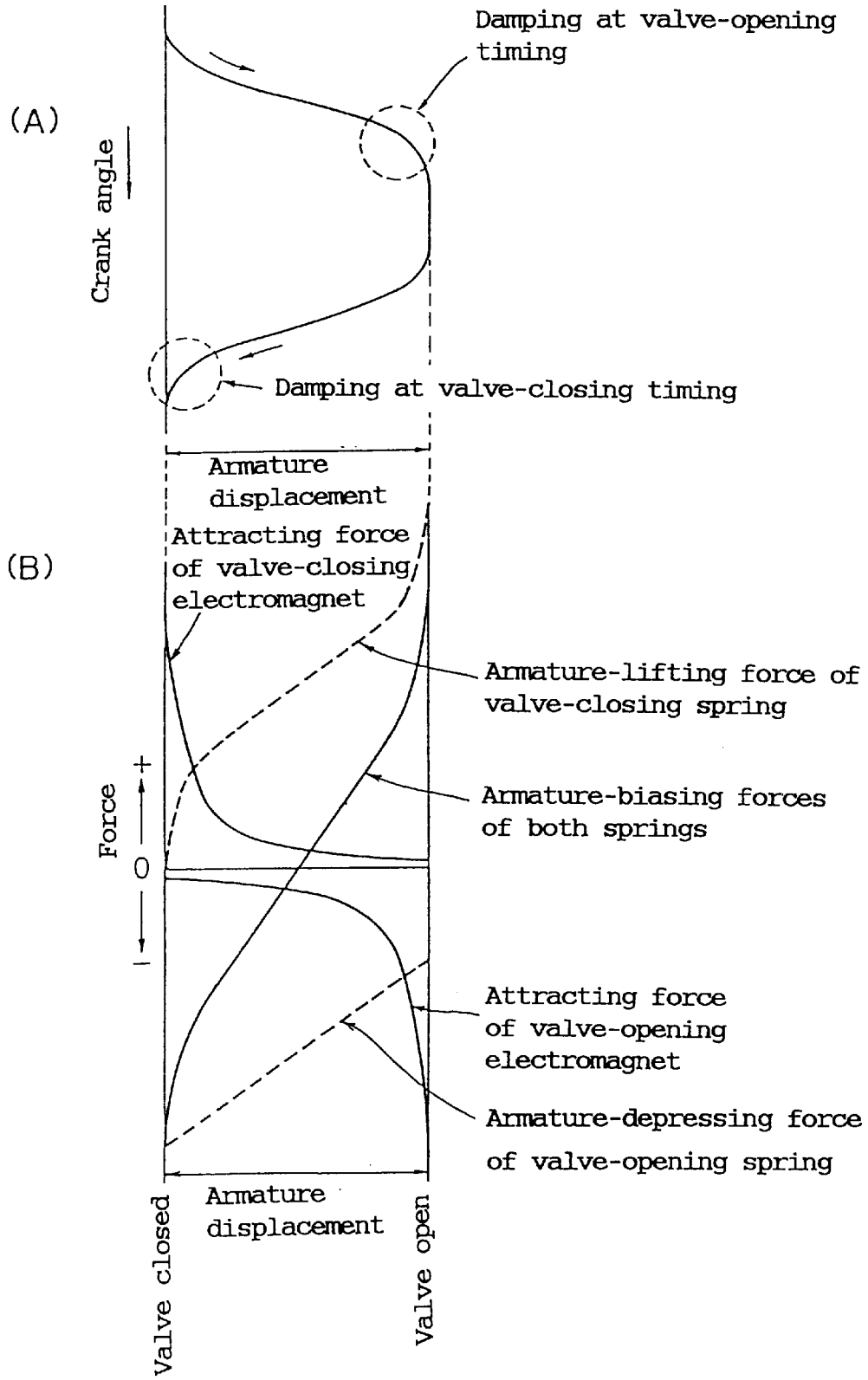
FIG. 6A is a diagram showing characteristics of the intake valve at the opening and closing timings.
FIG. 6B is a diagram showing characteristics of attracting forces of electromagnets and biasing forces of springs.

Referring now to FIGS. 6A and 6B, there is provided a discussion with respect to characteristics of the attracting forces of the respective electromagnets 31 and 32 and characteristics of the biasing forces of the respective springs 28 and 33, which are exhibited at the opening and closing timings of the intake valve 23, respectively. In these figures, an axis of abscissae represents displacement of the armature 30. An amount of displacement of the armature 30 is approximately ½ of an amount of the lift of the intake valve 23 at the opening and closing timings because of the arrangement of profiles of the first and second cam surfaces 51 and 52 of the transmission cam 46. The electromagnetic attracting forces of the electromagnets 31 and 32 are reduced to approximately ½ by the leverage of the transmission cam 46 and transferred to the intake valve 23, whereby it is required to increase the electromagnetic attracting forces thereof. However, since the electromagnetic attracting forces are substantially inversely proportional to the square of the distance between the armature 30 and the fixed cores 31*a* and 32*a* of the respective electromagnets 31 and 32 as described above, the electromagnetic attracting forces increase approximately four times. Therefore, in a case where an amount of the stroke of the armature 30 is reduced by the leverage of the transmission cam 46, greater electromagnetic attracting forces can be obtained so that the effective use of the electromagnets 31 and 32 can be achieved.

Further, in this embodiment, a gentle characteristic curve of the operation of the intake valve 23 is obtained within terminal end regions, as circled by the broken line in FIG. 6A, of the opening and closing strokes of the intake valve 23.

Specifically explaining by mentioning the closing timing of the intake valve 23, the biasing forces of the valve-closing spring 28 and the valve-opening spring 33 relative to the transmission cam 46 in the closing and opening directions become closer to substantially zero within the end regions of the closing and opening strokes of the intake valve 23, respectively.

Figure 7:
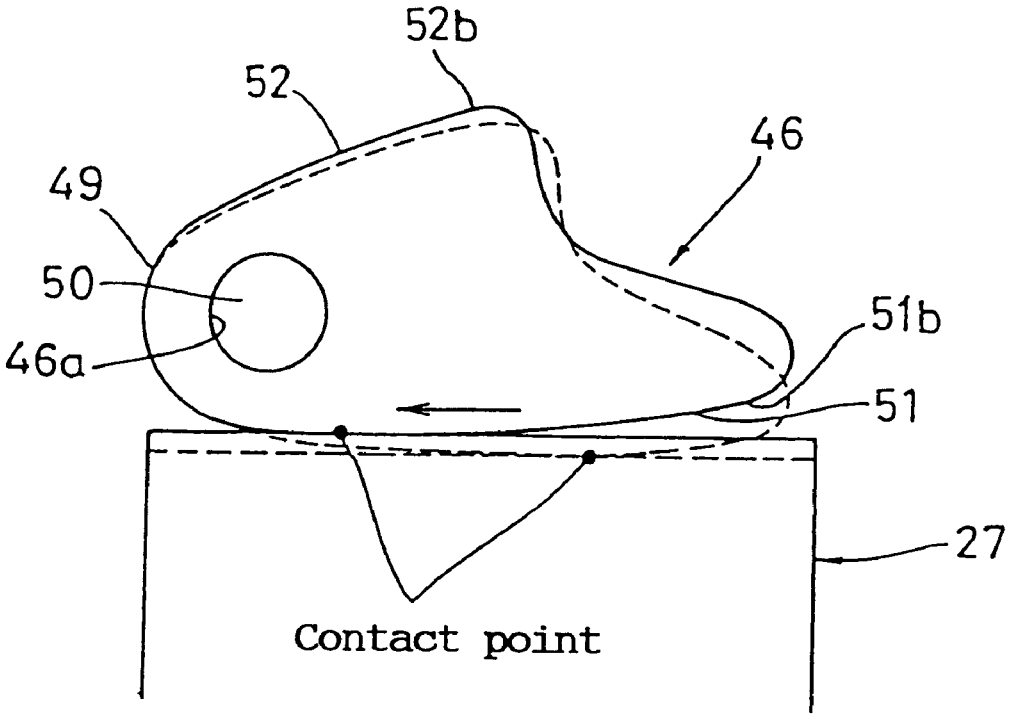
FIG. 7 is an explanatory diagram showing an operation of the transmission cam.

Namely, for instance, upon actuating the intake valve 23 in the closing direction, as the valve lifter 27 rises up by the electromagnetic force and the biasing force of the valve-closing spring 28, the contact point of the valve lifter 27 and the transmission cam 46 is moved from one end portion on the side of the first lift portion 51*a* of the first lamp 51*a* onto the opposite end portion on the side of the base portion 49 as illustrated in FIG. 7. Therefore, a rotation moment of the transmission cam 46 that is caused by the biasing force of the valve-closing spring 28 through the valve lifter 27 becomes closer to zero. Therefore, the biasing force of the valve-closing spring 28 that is transmitted from the transmission cam 46 to the tappet 39 and the armature 30, becomes closer to zero. This specific operating function occurs at the valve opening timing.

Accordingly, basically, with the arrangement of the first and second lamp portions 51*a* and 52*a* of the transmission cam 46, it becomes possible to mechanically restrict an abrupt movement of the valve lifter 27, specially at the intake valve closing timing, and an abrupt movement of the armature 30, specially at the intake valve opening timing. As a result, the intake valve 23 has the gentle characteristic curve of the operation in each of the end regions of the opening and closing strokes. Summarizing, the transmission cam 46 is oscillated by the valve-closing and valve-opening springs 28 and 33 and the attracting forces of the electromagnets 31 and 32, to generate the rotation moment causing a greater control force that acts for the damping function.

Furthermore, as shown in FIG. 6B, the resultant force of the biasing forces of the springs 28 and 33 that acts on the armature 30, steeply increases in the vicinity of each of the upper and lower limits of the displacement of the armature 30. This characteristic of the increasing resultant force effectively acts as a damping force in the end regions of the respective opening and closing strokes of the intake valve 23.

Accordingly, as indicated in a circle shown by the broken line in FIG. 6A, the intake valve 23 exhibits a stable damping function at the opening and closing timings. As a result, the valve head 23*a* is avoided from abutting against the valve seat 22*a* as well as the armature 30 is restricted from abutting against the valve-opening electromagnet 32. The occurrence of strike noise, abrasion and the like is restrained.

Meanwhile, when the armature 30 terminates its upward movement to be closer to the valve-closing electromagnet 31 at the closing timing of the intake valve 23, it is likely that the tappet 39 is temporarily spaced from the transmission cam 46 so that the armature 30 may be under insufficient control of the transmission cam 46 with the profile. However, since the resultant force of the biasing forces of the respective springs 28 and 33 increases as described above, the armature 30 is prevented from conflicting with the valve-closing electromagnet 31.

In this embodiment, the electromagnetically actuating mechanism 24 and the intake valve 23 are arranged as separate parts. With this arrangement, when the transmission cam 46 is not in a position in which it urges the valve lifter 27, namely, the intake valve is closed, the intake valve 23 can be urged stably and certainly by the biasing force of the valve-closing spring 28 in the closing direction. Besides, since the clearance between the transmission cam 46 and the valve stem 23*b* of the intake valve 23 is always adjusted to zero by the hydraulic lash adjuster 47, the valve head 23*a* is assured to be tightly contacted with the valve seat 22*a*. This is because the hydraulic lash adjuster 47 absorbs the displacement of the upward movement of the valve lifter 27 that is caused due to thermal expansion of the intake valve 23, abrasion of the valve seat 22*a*, or the like. Meanwhile, the transmission cam 46 is so configured as to always urge upward the head of the body 47*a* of the hydraulic lash adjuster 47 through the arm 48. Specifically, the transmission cam 46 is formed into such a shape that the second lift portion 52*b* is widely spread relative to the first lift portion 51*b* so as to be urged onto the tappet 39. With this arrangement, the cam shaft 50 is urged downward so that the other end portion 48*b* of the arm 48 is always urged upward to lift the body 47*a*.

Further, since the arrangement of the intake valve 23, the valve lifter 27 and the valve-closing spring 28 is similar to the valve-operating structure of the conventionally used cam shaft type, the assembly work of mounting these components to the cylinder head 21 can be facilitated. In addition, since the electromagnetically actuating mechanism 24 and the transmission mechanism 25 are installed into the casing 29 to form one unit before mounting onto the cylinder head 21, such miscellaneous assembly work as conventionally conducted on the cylinder head 21 can be omitted, serving for improving mountability, viz. assembling efficiency, of the whole actuator relative to the engine.

Figure 8:
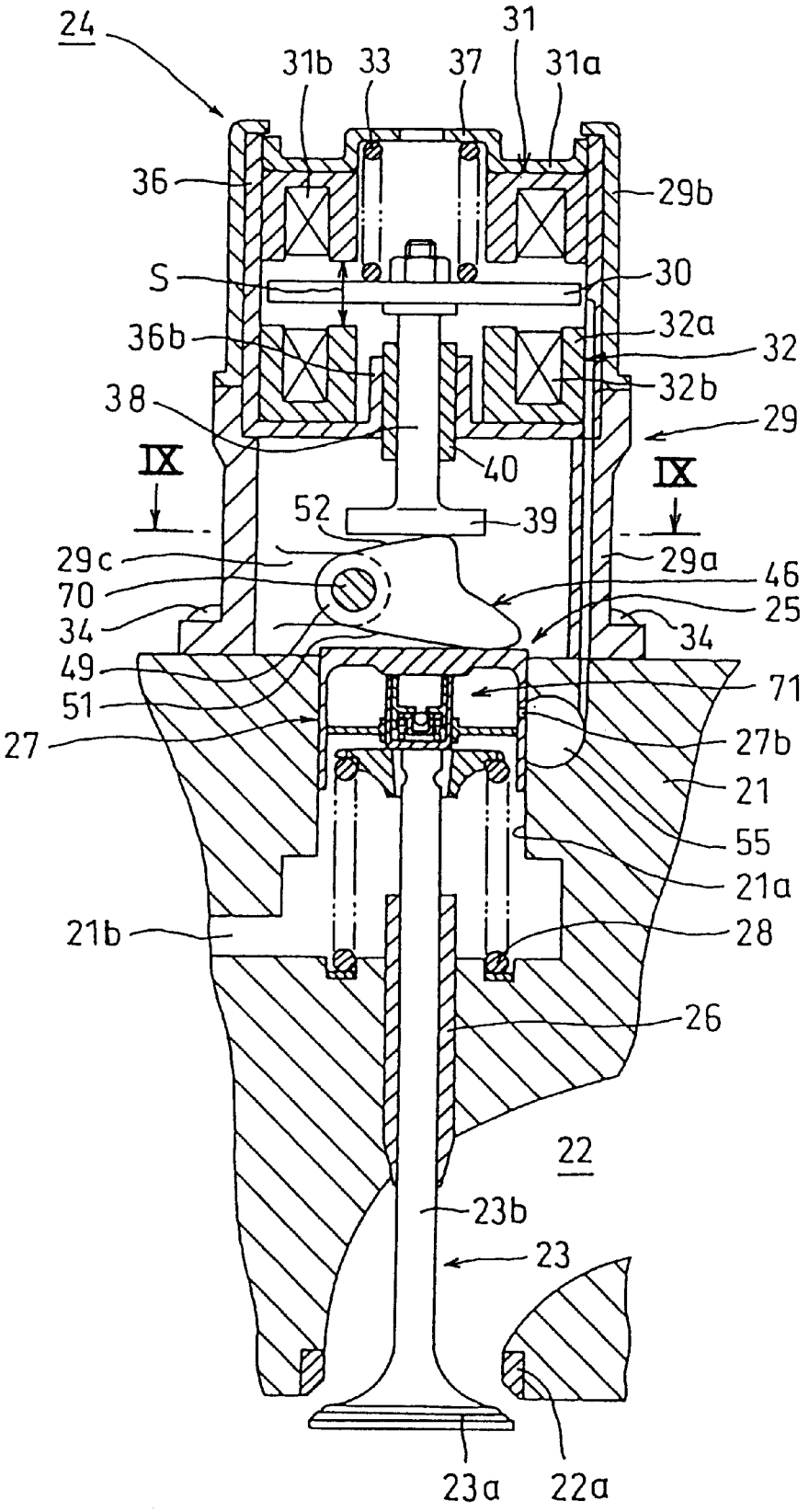
FIG. 8 is a vertical cross section of an actuator of a second embodiment according to the invention.

FIG. 8 shows a second embodiment of the present invention in which the structure of supporting the transmission cam 46 and the arrangement and the structure of the lash adjuster 71 are modified.

Figure 9:
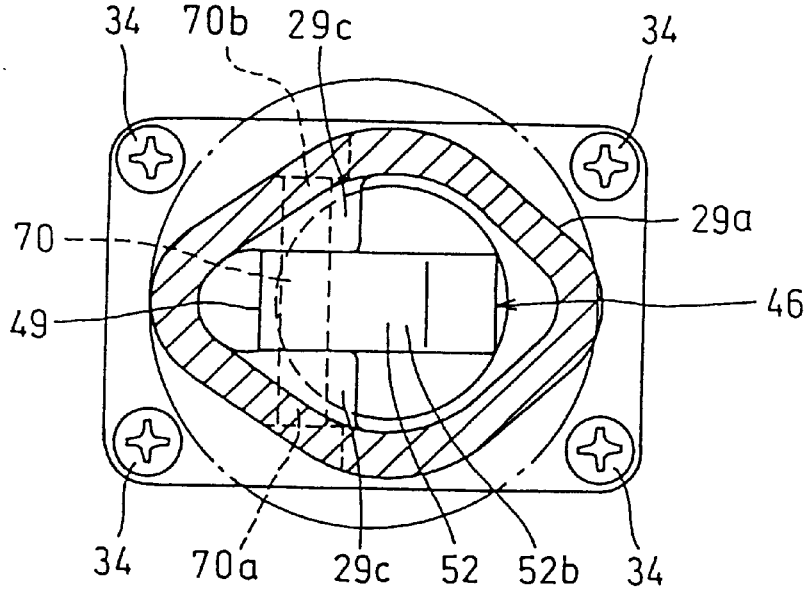
FIG. 9 is a section taken along line IX—IX of FIG. 8.

Specifically, as illustrated in FIGS. 8 and 9, the casing 29 includes a body 29*a* made of metal and fixed to the cylinder head 21 by using four screws 34. The body 29*a* is formed into a generally rhombus shape in section that has substantially the same maximum outer diameter as that of a cylindrical cover 29*b* fixed to an upper end of the body 29*a*. The cover 29*b* is made of non-magnetic material. A pair of radially inwardly projecting boss portions 29*c*, 29*c* are disposed on a lower portion of the inner circumferential surface of the casing 29 in substantially opposed relation. The boss portions 29*c*, 29*c* have a shape of the letter U in a side view.

The transmission cam 46 has the same configuration as one of the first embodiment, which includes the first arcuately convex cam surface 51 on its lower face contacted with the upper face of the valve lifter 27 and the second arcuately convex cam surface 52 on its upper face contacted with the lower face of the tappet 39. The arcuate base portion 49 disposed at the one end of the transmission cam 46 is interposed between the boss portions 29*c*, 29*c* and mounted onto a cam shaft 70 having both end portions 70*a* and 70*b* that are fixed to the boss portions 29*c*, 29*c*. The transmission cam 46 is pivotal about the cam shaft 70 as the fulcrum so that the other end thereof moves upward and downward.

Figure 10:
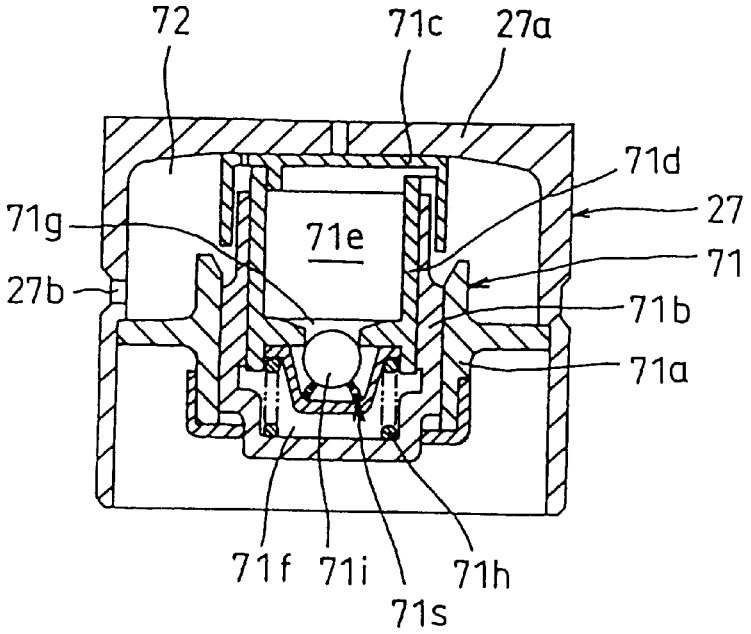
FIG. 10 is a vertical cross section of a hydraulic valve lifter used in the second embodiment.

Further, a hydraulic lash adjuster 71 is disposed within the valve lifter 27, that is adapted for adjusting the valve clearance of the intake valve 23 to zero. The hydraulic lash adjuster 71 is a generally known type as shown in FIG. 10. The hydraulic lash adjuster 71 includes a cylindrical partition wall 71*a* disposed at the center of the valve lifter 27, and a closed-ended cylindrical plunger 71*b* slidable on an inner circumferential surface of the cylindrical partition wall 71*a*. The hydraulic lash adjuster 71 also includes a plunger head 71*c* disposed on a lower face of an upper wall 27*a* of the valve lifter 27, and a plunger seat 71*d* that is disposed within the plunger 71*b* and has an upper end portion fixed to the plunger head 71*c*. A reservoir chamber 71*e* is disposed within the plunger seat 71*d*. A high-pressure chamber 71*f* is disposed within a bottom portion of the plunger 71*b*.

The high-pressure chamber 71*f* and the reservoir chamber 71*e* are communicated with each other by a communication hole 71*g* that is open and closed by a check ball 71*i*. The check ball 71*i* is biased by a spring 71*s* in such a direction as close the communication hole 71*g*. Further, the reservoir chamber 71*e* is always supplied with a fluid pressure fed from an oil main gallery 55 via an oil reservoir chamber 72 within an upper portion of the valve lifter 27 and a through-hole 27*b* formed in a side wall of the valve lifter 27. In addition, the plunger 71*b* has a bottom wall that is contacted at the center with an upper end of the valve stem 23*b* of the intake valve 23.

In a case where a clearance between the base portion 49 of the transmission cam 46 and the upper face of the valve lifter 27 is generated due to abrasion of the mutually contacting surfaces, leak of the fluid pressure, or the like, under condition that the intake valve 23 is closed and the base portion 49 is contacted with the upper face of the valve lifter 27, the plunger 71*d* and the lifter upper wall 27*a* are urged upward by the spring 71*h* so that the fluid is permitted to flow into the high-pressure chamber 71*f* through the check ball 71*i*. Then, the clearance between the base portion 49 of the transmission cam 46 and the upper face of the valve lifter 27 is reduced. Thus, the clearance between the transmission cam 46 and the valve lifter 27 is always adjusted to zero. Meanwhile, the remainder is the same in structure as the first embodiment.

According to this embodiment, when the engine is stopped, the armature 30 is maintained at the neutral position by the relative biasing forces of the springs 28 and 33 as illustrated in FIG. 8. Therefore, the intake valve 23 is in the neutral position spaced from the valve seat 22*a* by a certain distance. At this time, the transmission cam 46 is conditioned that the first lift portion 51*b* of the first cam surface 51 is contacted with the upper face of the valve lifter 27 and the lift portion of the second cam surface 52 is contacted with the lower face of the tappet 39.

Figure 11:
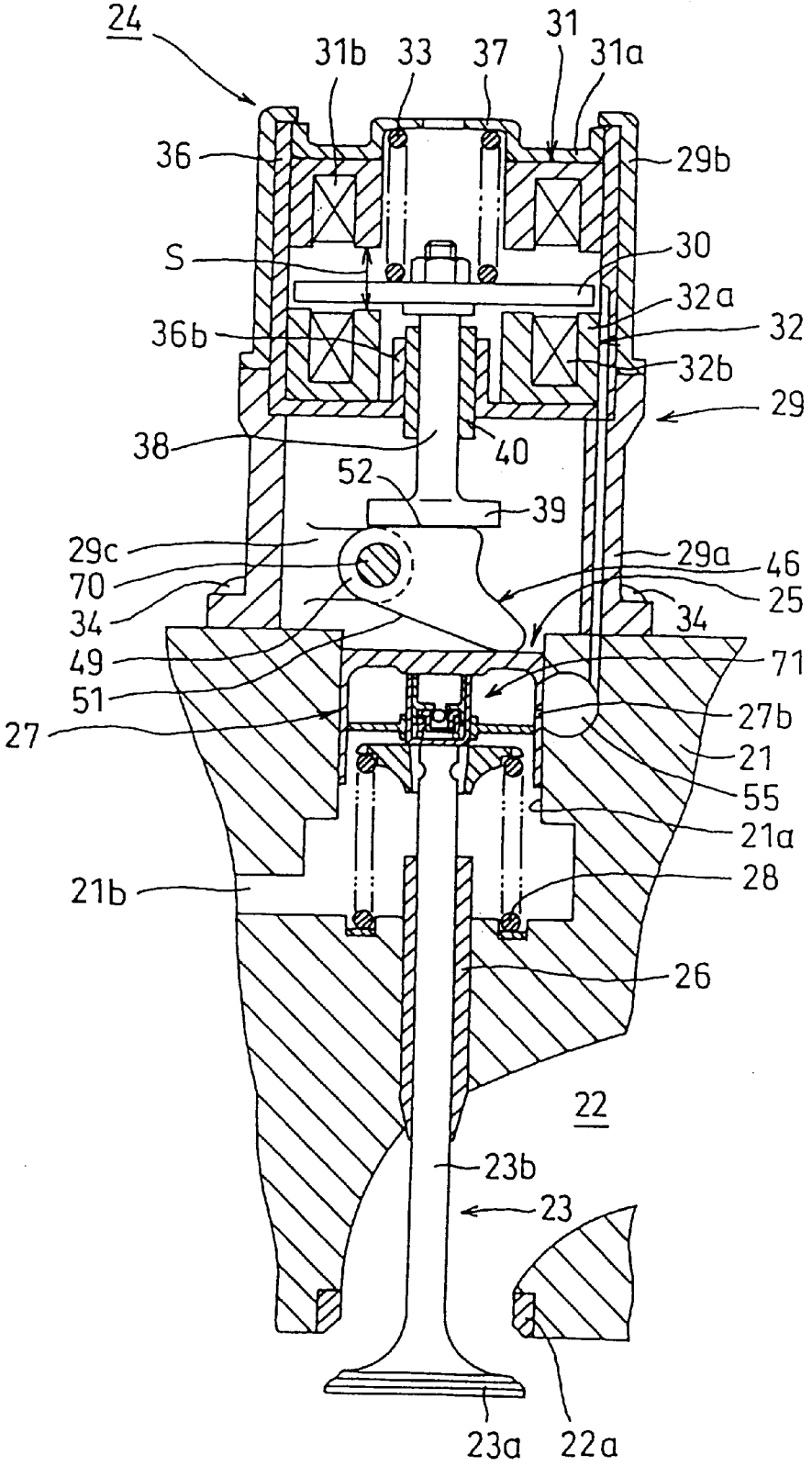
FIG. 11 is a vertical cross section of the actuator, showing a condition in which the intake valve is open.

When the intake valve 23 opens after start-up of the engine, the electromagnetic coil 32*b* of the valve-opening electromagnet 32 is energized so that the armature 30 is moved downward as shown in FIG. 11, by the attracting force of the electromagnet 32 and the biasing force of the valve-opening spring 33. Then, the tappet 39 urges the transmission cam 46 downwardly to pivot around the cam shaft 70 as the fulcrum downwardly, viz. in a clockwise direction. The first lift portion 51*b* of the first cam surface 51 urges the upper face of the valve lifter 27 against the biasing force of the valve-closing spring 28, causing the intake valve 23 to open.

Figure 12:
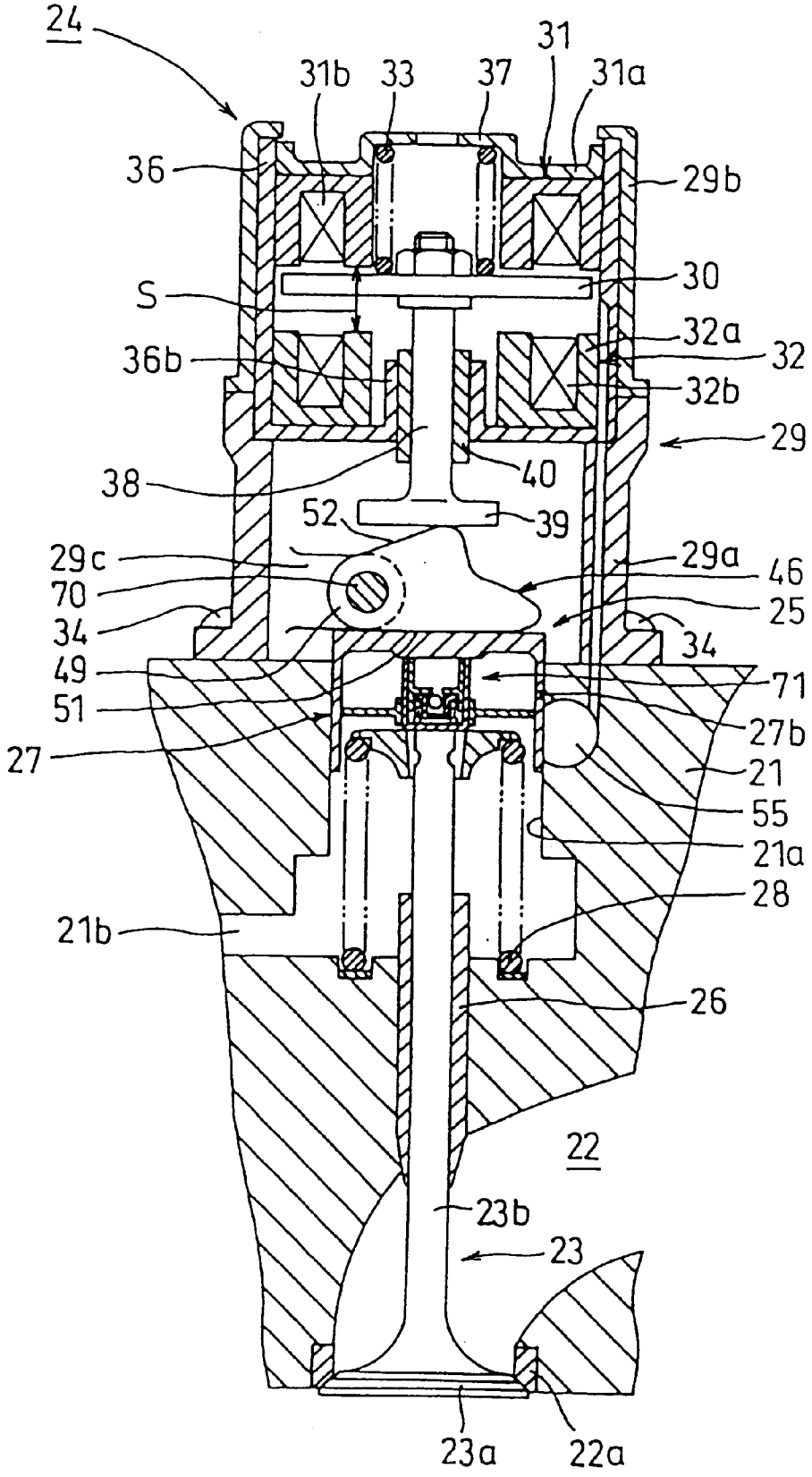
FIG. 12 is a vertical cross section of the actuator, showing a condition in which the intake valve is closed.

When the intake valve 23 is closed, the electromagnetic coil 31*b* of the valve-closing electromagnet 31 is energized so that the armature 30 is attractively moved toward the electromagnet 31 as shown in FIG. 12. At the same time, the transmission cam 46 is pivoted upward, viz. in a counter-clockwise direction, by the biasing force of the valve-closing spring 28. Then, the first lamp portion 51*a*, as a whole, of the first cam surface 51 rotatively contacts the upper face of the valve lifter 27 and the second lift portion 52*b* of the second cam surface 52 urges the tappet 39 upward. This causes the intake valve 23 to move upward against the biasing force of the valve-opening spring 33, placing the valve head 23*a* on the valve seat 22*a*. Thus, the intake valve 23 is closed.

Accordingly, with the arrangement of the transmission cam 46, the damping function at the opening and closing timings of the intake valve 23 can be obtained as well as the first embodiment.

Further, as described in this embodiment, since the lash adjuster 71 is disposed not within the casing 29 but inside the valve lifter 27, the outer diameter of the casing body 29*a* can be considerably reduced. As a result, the assembly work of combining the electromagnetically actuating mechanism 24 with the transmission mechanism 25 can be facilitated and the actuator as a whole can be made compact.

Furthermore, since the transmission cam 46 is supported stably and surely at the base portion 49 by the cam shaft 70 interposed by the boss portions 29*c*, 29*c* of the casing body 29*a*, the upward and downward pivotal movement thereof can be always stabilized. To this end, the clearance between the electromagnets 31 and 32 and the armature 30 can be readily adjusted.

Figure 13:
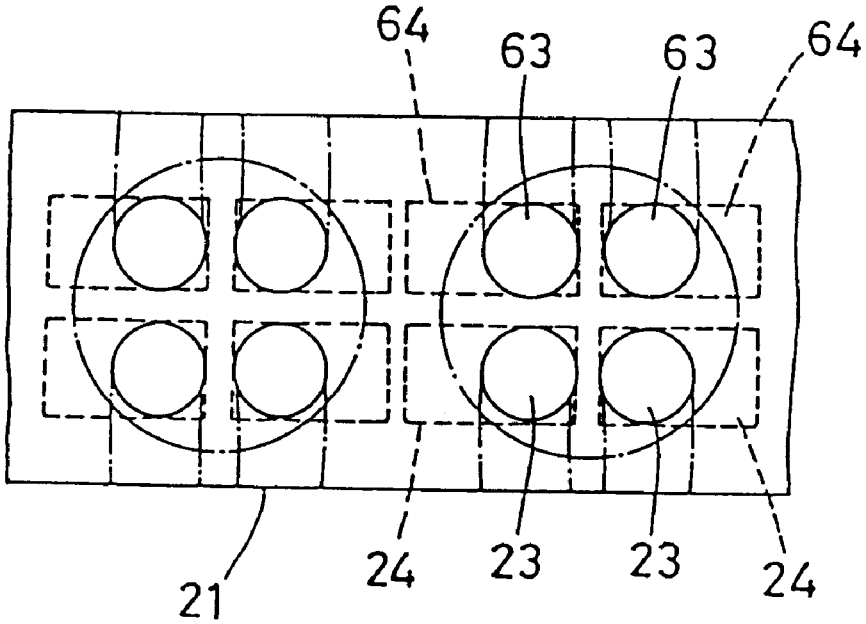
FIG. 13 is a schematic plan view of an actuator of a third embodiment according to the invention.
Figure 14:
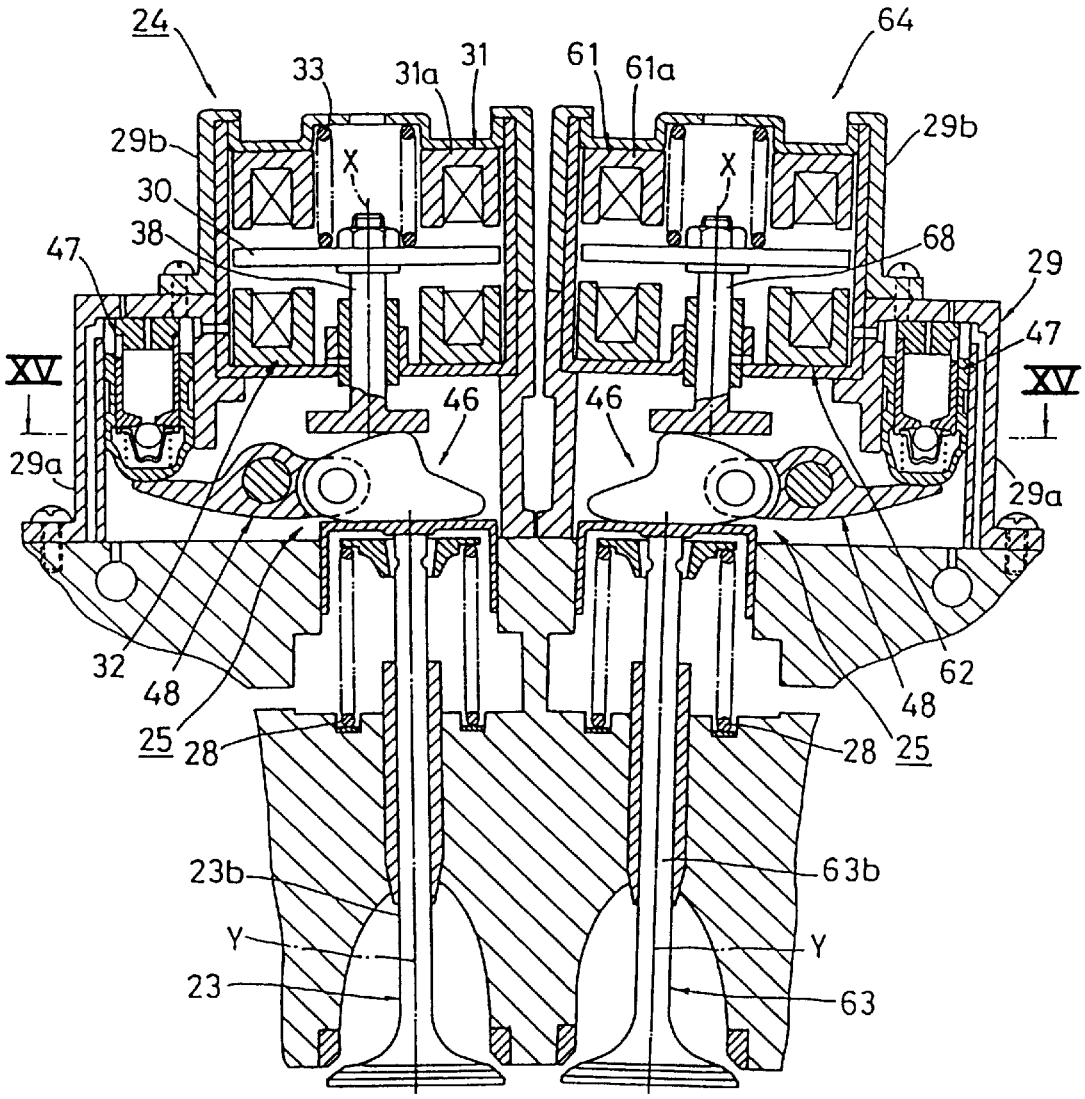
FIG. 14 is a vertical cross section of the actuator of the third embodiment.
Figure 15:
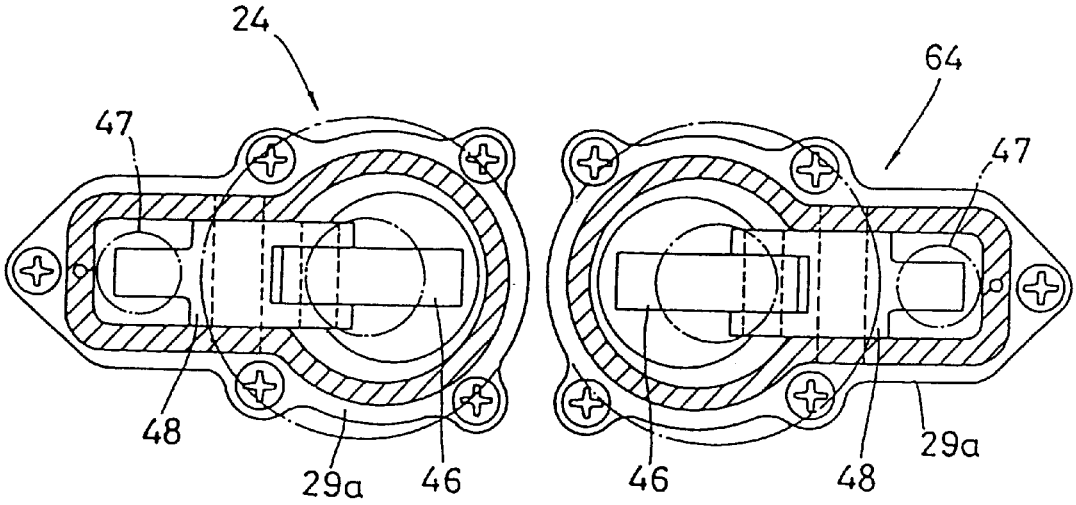
FIG. 15 is a section taken along line XV—XV of FIG. 9.
Figure 16:
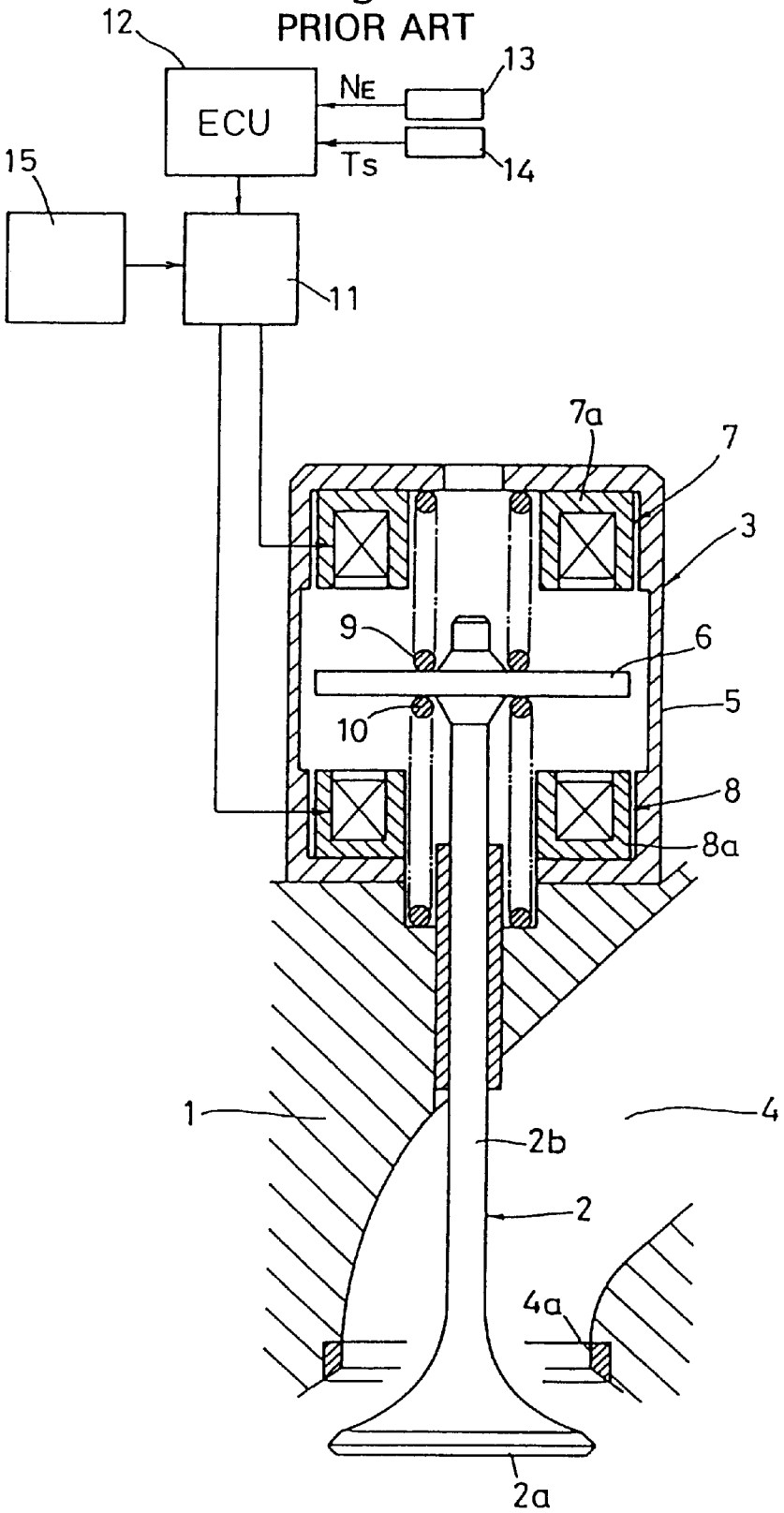
Fig. 16 PRIOR ART
FIG. 16 is a vertical cross section of a conventional actuator.
Figure 17A:
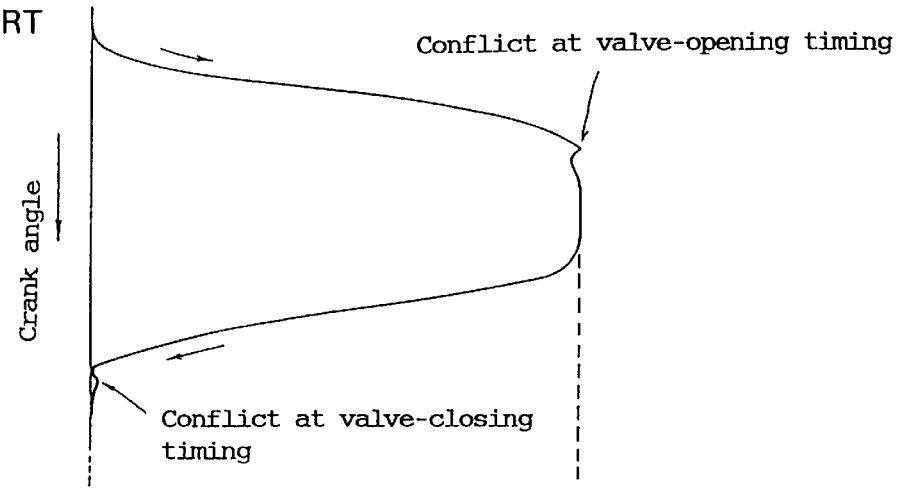
Fig. 17(A) PRIOR ART
FIG. 17A is a diagram showing characteristics of an intake valve at the opening and closing timings in the conventional actuator.
Figure 17B:
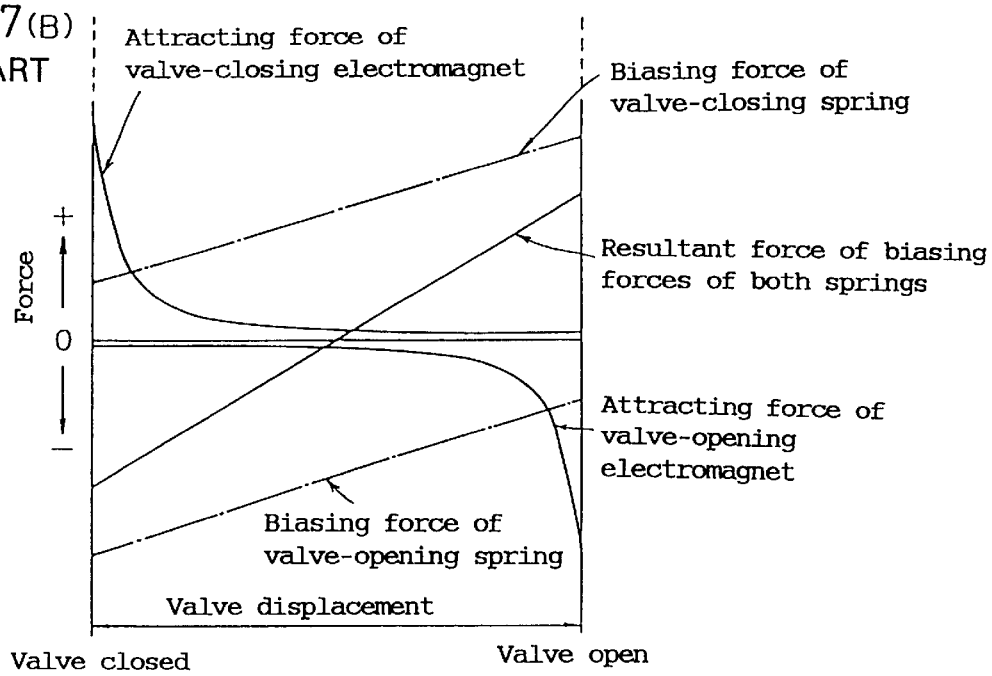
Fig. 17(B) PRIOR ART
FIG. 17B is a diagram showing characteristics of attracting forces of electromagnets and biasing forces of springs in the conventional actuator.

FIGS. 13 to 15 show a third embodiment of the present invention, which is applied to two intake valves 23, 23 and two exhaust valves 63, 63 disposed within each cylinder.

Namely, according to the present invention, the axis Y of each of the valve stems 23*b* and 63*b* and the axis X of the tappet shaft 68 are offset from each other in the width direction of the engine. In the case of being applied to the engine of such four-valve type, the electromagnetically actuating mechanisms 24, 24 and 64, 64 are arranged in the width direction of the engine, whereby the electromagnets 31, 32, 61 and 62 each having a relatively large diameter are easily arranged. Meanwhile, if the diameters of the electromagnets 31, 32, 61 and 62 are increased, the electromagnetic forces thereof become greater to be applicable to increase in the speed of the engine.

As illustrated in FIG. 14, the left and right valve-closing electromagnets 31 and 61 are arranged in an inclined relation such that upper portions thereof are spaced from each other by a certain distance. With this arrangement, the fixed cores 31*a* and 61*a* can be increased in diameter to make the electromagnetic forces greater. In this case, the intake valves 23 may be arranged in such a way that the upper portions thereof are inclined relative to each other or may be arranged without having the inclined relation. This achieves a wide variety of the design of configuration of a combustion chamber.

As appreciated from the above description, the electromagnetically operating actuator for intake and/or exhaust valves, according to the present invention, can considerably restrain the abrupt opening and closing movements of the intake and/or exhaust valves within the end region of the opening and closing strokes. The serious conflict of the valve head with the valve seat can be damped as well as the conflict of the armature with the valve-closing electromagnet. As a result, large strike noise, abrasion and the like which tend to be caused by the conflict, can be prevented.

According to another aspect of the invention, the lash adjuster can absorb upward displacement of the upper end of the valve lifter that is caused due to thermal expansion of the intake and/or exhaust valves, or the like, always adjusting the clearance between the transmission cam and the valve lifter to zero. Therefore, the intake and/or exhaust valves can be stably maintained in the closed position by the biasing force of the valve-closing spring member.

Further, according to another aspect of the invention, the intake and/or exhaust valves, the valve-closing spring, the valve lifter and the like can be provided separately from the electromagnetically actuating mechanism, and the electromagnetically actuating mechanism and the transmission mechanism can be accommodated together in the casing to form one unit. This improves efficiency of the assembly work of the actuator and mountability of the actuator relative to the cylinder head.

According to another aspect of the invention, the lash adjuster is disposed within not the casing but the valve lifter, whereby the outer diameter of the casing can be considerably reduced. This can facilitate the assembly work of combining the electromagnetically actuating mechanism with the transmission mechanism and make the whole actuator compact for readily mounting onto the cylinder head.

INDUSTRIAL APPLICABILITY

The actuator according to the present invention is applicable to not only the intake valve but also the exhaust valve. In a case where the actuator is applied to the exhaust valve, the exhaust valve can be prevented from abruptly moving at the opening timing, so that sudden exhaust of combustion gas can be restrained. This enables exhaust sound to be reduced.

What is claimed is:

1. An electromagnetically operating actuator including an armature having a tappet associated with intake and/or exhaust valves of an engine, valve-opening and valve-closing electromagnets attracting the armature to open and close the intake and/or exhaust valves, and valve-opening and valve-closing spring members biasing the intake and/or exhaust valves in the opening direction and the closing direction to retain the intake and/or exhaust valves in neutral positions, comprising:

a transmission mechanism for transmitting force from the tappet to the intake and/or exhaust valves to open and close the intake and/or exhaust valves, said transmission mechanism including a pivotally movable transmission cam interposed between a valve stem of each of the intake and/or exhaust valves, and the tappet, which is associated with the armature and in opposed relation to the valve stem substantially along a direction of movement of the valve stem, the transmission cam having a second cam surface that receives the force from the tappet and a first cam surface that transmits the force to the valve stem.

2. An electromagnetically operating actuator as claimed in claim 1, wherein the first cam surface is convexly arcuate and is adapted to contact a valve lifter, which abuts an upper end of the valve stem, and the second cam surface is convexly arcuate and is adapted to contact the tappet, said transmission cam being pivotable a its one end as a fulcrum.

3. An electromagnetically operating actuator as claimed in claim 2, wherein said second cam surface has a shorter surface length than a surface length of the first cam surface to thereby determine a lift amount of said tappet that is less than a lift amount of said valve lifter, said lift amount of said valve lifter being obtained by the pivotal movement of said transmission cam.

4. An electromagnetically operating actuator as claimed in claim 2, wherein said valve-closing spring member is adapted to be positioned between the valve lifter and a cylinder head and wherein a lash adjuster for adjusting a valve clearance of the intake and/or exhaust valves to zero is associated, via an arm, with a cam shaft supporting said one end of said transmission cam so as to be pivotable thereon.

5. An electromagnetically operating actuator as claimed in claim 1, wherein an axis of the valve stem of the intake and/or exhaust valves and an axis of a tappet shaft of the tappet are offset from each other in a width direction of the engine.

6. An electromagnetically operating actuator as claimed in claim 5, further including a casing housing the armature, the electromagnets, the tappet, and the transmission mechanism including the transmission cam and the lash adjuster, and wherein said casing is adapted to be secured onto a cylinder head.

7. An electromagnetically operating actuator as claimed in claim 2, wherein the valve-closing spring member is adapted to be positioned between the valve lifter and a cylinder head and where a lash adjuster for adjusting the valve clearance of the intake and/or exhaust valves to zero is disposed within the valve lifter.

8. An electromagnetically operating actuator as claimed in claim 6, wherein the casing has a pair of opposed boss portions that are disposed on an inner surface thereof for accommodating the transmission cam, and wherein the transmission cam is adapted to move pivotally upward and downward about a cam shaft, as a fulcrum, that is disposed between said pair of opposed boss portions.

* * * * *